US010760790B2

(12) United States Patent
Chang

(10) Patent No.: US 10,760,790 B2
(45) Date of Patent: Sep. 1, 2020

(54) BOOSTER BURNER

(71) Applicant: PURE METHANOL ENERGY TECHNOLOGY CO., LTD., New Taipei (TW)

(72) Inventor: Teng-Yun Chang, New Taipei (TW)

(73) Assignee: Pure Methanol Energy Technology Co., Ltd., New Taipei (TW)

( * ) Notice: Subject to any disclaimer, the term of this patent is extended or adjusted under 35 U.S.C. 154(b) by 187 days.

(21) Appl. No.: 15/906,298

(22) Filed: Feb. 27, 2018

(65) Prior Publication Data

US 2019/0186736 A1 Jun. 20, 2019

(30) Foreign Application Priority Data

Dec. 15, 2017 (TW) ..... 106144282 A

(51) Int. Cl.

| | |
|---|---|
| ***F23D 11/44*** | (2006.01) |
| ***F23L 9/00*** | (2006.01) |
| ***F23N 3/08*** | (2006.01) |
| ***F23D 11/38*** | (2006.01) |

(Continued)

(52) U.S. Cl.

CPC ..... *F23L 9/00* (2013.01); *F23D 11/26* (2013.01); *F23D 11/38* (2013.01); *F23D 11/404* (2013.01); *F23D 11/406* (2013.01); *F23D 11/44* (2013.01); *F23N 3/087* (2013.01); *F23D 2207/00* (2013.01); *F23N 2237/16* (2020.01)

(58) Field of Classification Search

CPC ..... F23L 9/00
USPC ..... 431/187
See application file for complete search history.

(56) References Cited

U.S. PATENT DOCUMENTS 4,957,427 A * 9/1990 Fullemann ..... F23D 11/005 431/265
5,252,059 A * 10/1993 May ..... F23C 9/006 431/116

(Continued)

FOREIGN PATENT DOCUMENTS

CN 2459542 Y 11/2001
CN 104896471 U 9/2015

(Continued)

OTHER PUBLICATIONS

Combined Search and Examination Report Issued by a Foreign Patent Office for Patent Application No. GB1806618.3.

*Primary Examiner* — Avinash A Savani
(74) *Attorney, Agent, or Firm* — Rosenberg, Klein & Lee

(57) ABSTRACT

A booster burner of the present disclosure basically has a burning unit, an air blower disposed at a rear end of a burning chamber of the burning unit and a high-pressure gas providing unit; wherein the burning unit has a fuel bucket for storing fuel and a burning chamber having a tubular shape, interior of the burning chamber has at least one nozzle, at least one fuel tube coupled to the fuel bucket is disposed at each the nozzle; and the high-pressure gas supplying unit has a gas storage bucket for storing high-pressure gas, each the nozzle is installed with a high-pressure pipe coupled to the gas storage bucket. Through the high-pressure gas, the slight atomization and acceleration effect is applied to the fuel which enters the nozzle, such that fuel molecules are refined and more completely burned, and the objective of increasing the fuel burning efficiency is achieved.

11 Claims, 9 Drawing Sheets

(51) Int. Cl.
*F23D 11/40* (2006.01)
*F23D 11/26* (2006.01)

(56) References Cited

U.S. PATENT DOCUMENTS

| | | | | | |
|---|---|---|---|---|---|
| 5,259,755 | A * | 11/1993 | Irwin | F23D 17/002 | 431/182 |
| 5,346,391 | A * | 9/1994 | Fullemann | F23C 9/006 | 431/116 |
| 5,349,811 | A * | 9/1994 | Stickler | F02C 9/28 | 60/39.281 |
| 5,368,011 | A * | 11/1994 | Bodner | F23C 3/00 | 126/110 R |
| 2007/0264602 | A1 | 11/2007 | Frenette et al. | | |
| 2008/0220383 | A1* | 9/2008 | Neville | F23C 6/047 | 431/12 |
| 2010/0209858 | A1 | 8/2010 | Frenette et al. | | |

FOREIGN PATENT DOCUMENTS

| | | | |
|---|---|---|---|
| CN | 206556008 | U | 10/2017 |
| DE | 2914120 | A1 | 10/1979 |
| GB | 125723 | | 4/1919 |
| GB | 182182 | | 6/1922 |
| GB | 811863 | | 4/1959 |
| GB | 2204674 | | 11/1988 |

* cited by examiner

BOOSTER BURNER

BACKGROUND

1. Technical Field

The present disclosure relates to a burner, in particular to a booster burner capable of efficiently increasing fuel burning efficiency.

2. Description of Related Art

According to prior art, the burner is widely used in a boiler, a heating furnace, a drying equipment and an industrial furnace and other thermal machinery, and the basic architecture of the conventional burner is shown as FIG. 1. The conventional burner is installed with a burning chamber 12 coupled to a fan 11, and interior of the burning chamber 12 is installed with a plurality of nozzles 13 coupled to a fuel providing device (not shown in the drawings). Mainly, the fan 11 generates the accelerating gas fluid in the burning chamber 12, and after the fuel injected into the burning chamber 12 is fired, accompanying the gas fluid in the burning chamber 12, the fire can be spurted and burned at the front end of the burning chamber 12.

The fuel of the conventional burner is mostly the diesel with good ignitability. Currently, there is also a burner provided as follows. After the burner utilizes a heater to heat the heavy oil to the high temperature of 110 degrees Celsius, the high-pressure pump transfers the heated heavy oil to the firing position via the pipeline, and thus the heavy oil can be the fuel. The most applications of the burners currently are applied thermal machineries and applied heat exchange devices, both of which are directly coupled to the front ends of the burning chambers 12 of the burner, and thus the used fuel burning efficiencies are entirely determined according to whether the supplying oxygen of the burning chamber 12 is sufficient.

Though the similar conventional burner can use the fan to generate the accelerating gas fluid, the fuel in practice is transferred to the nozzle by merely using the pump disposed at the fuel bucket, and then to the burning chamber through the nozzle. Since the pressure of the burning chamber is not relatively sufficient when the fuel enters the burning chamber, and mostly the fuel is not completely burned, the burner is unable to maintain the demanded burning efficiency.

SUMMARY

Accordingly, the present disclosure provides a booster burner capable of efficiently increasing fuel burning efficiency.

A booster burner of the present disclosure comprises: a burning unit, an air blower and a high-pressure gas providing unit; wherein: the burning unit is installed with a fuel bucket for storing fuel and a burning chamber having a tubular shape, interior of the burning chamber is installed with at least one nozzle, at least one fuel tube coupled to the fuel bucket is disposed at each the nozzle; the air blower is coupled to the burning chamber; and the high-pressure gas supplying unit is installed with a gas storage bucket for storing high-pressure gas, each the nozzle is installed with a high-pressure pipe coupled to the gas storage bucket.

Accordingly, under the reaction of the high-pressure gas supplying unit, the booster burner of the present disclosure can apply the accelerating effect to the fuel which enters the nozzle, and after the fuel passes the nozzle, the atomization effect of the fuel can be increased, and simultaneously the amount of the gas fluid which enters the burning chamber is increased, therefore achieving the objective of increasing fuel burning efficiency.

According to the above features, the booster burner further comprises a control unit; the control unit is installed with a control circuit, a lighter correspondingly disposed in the interior of the burning chamber, a fuel pump coupled to the fuel tube of each the nozzle and a throttle coupled to the high-pressure pipe of each the nozzle, the control circuit is at least electrically connected to the lighter, the fuel pump, the throttle and the air blower.

According to the above features, the booster burner further comprises a wind speed auxiliary unit; the wind speed auxiliary unit is installed with a wind speed bucket at least covering exterior of the air blower, a front end and a rear end of the wind speed bucket are open, a gap for providing passage of a gas fluid is formed between the wind speed bucket and the air blower, the rear end of the wind speed bucket is installed with a blade and a motor for driving the blade to spin.

According to the above features, the booster burner further comprises a wind speed auxiliary unit and a control unit; the wind speed auxiliary unit is installed with a wind speed bucket at least covering exterior of the air blower, a front end and a rear end of the wind speed bucket are open, a gap for providing passage of a gas fluid is formed between the wind speed bucket and the air blower, the rear end of the wind speed bucket is installed with a blade and a motor for driving the blade to spin; the control unit is installed with a control circuit, a lighter correspondingly disposed in the interior of the burning chamber, a fuel pump coupled to the fuel tube of each the nozzle and a throttle coupled to the high-pressure pipe of each the nozzle, the control circuit is at least electrically connected to the lighter, the fuel pump, the throttle, the air blower and the motor of the wind speed auxiliary unit.

According to the above features, the burning unit is installed with at least one jet pipe disposed at a front end of the burning chamber, and a pipe diameter of each the jet pipe is less than an inner diameter of the burning chamber.

According to the above features, the booster burner further comprises a control unit; the control unit is installed with a control circuit, a lighter correspondingly disposed in the interior of the burning chamber, a fuel pump coupled to the fuel tube of each the nozzle and a throttle coupled to the high-pressure pipe of each the nozzle, the control circuit is at least electrically connected to the lighter, the fuel pump, the throttle and the air blower; and the burning unit is installed with at least one jet pipe disposed at a front end of the burning chamber, and a pipe diameter of each the jet pipe is less than an inner diameter of the burning chamber.

According to the above features, the booster burner further comprises a wind speed auxiliary unit and a control unit; the wind speed auxiliary unit is installed with a wind speed bucket at least covering exterior of the air blower, a front end and a rear end of the wind speed bucket are open, a gap for providing passage of a gas fluid is formed between the wind speed bucket and the air blower, the rear end of the wind speed bucket is installed with a blade and a motor for driving the blade to spin; the control unit is installed with a control circuit, a lighter correspondingly disposed in the interior of the burning chamber, a fuel pump coupled to the fuel tube of each the nozzle and a throttle coupled to the high-pressure pipe of each the nozzle, the control circuit is at least electrically connected to the lighter, the fuel pump, the throttle, the air blower and the motor of the wind speed auxiliary unit; and the burning unit is installed with at least one jet pipe disposed at a front end of the burning chamber, and a pipe diameter of each the jet pipe is less than an inner diameter of the burning chamber.

According to the above features, the wind speed auxiliary unit is installed with a lubricant bucket for storing lubricant and at least one lubricant pipe coupled to the lubricant bucket and a pivot setting location on a rotating axis of the motor.

According to the above features, the wind speed auxiliary unit is installed with at least one hatch cover disposed at a tubular side of the wind speed bucket, wherein the hatch cover is capable of opening and closing.

According to the above features, the wind speed auxiliary unit is installed with a lubricant bucket for storing lubricant and at least one lubricant pipe coupled to the lubricant bucket and a pivot setting location on a rotating axis of the motor, and the wind speed auxiliary unit is installed with at least one hatch cover disposed at a tubular side of the wind speed bucket, wherein the hatch cover is capable of opening and closing.

According to the above features, the high-pressure gas supplying unit is further installed with an air compressor coupled to the gas storage bucket, and the air compressor is electrically connected to the control circuit of the control unit.

According to the above features, the high-pressure gas supplying unit is further installed with an air compressor coupled to the gas storage bucket, and the air compressor is electrically connected to the control circuit of the control unit; and the wind speed auxiliary unit is installed with a lubricant bucket for storing lubricant and at least one lubricant pipe coupled to the lubricant bucket and a pivot setting location on a rotating axis of the motor.

According to the above features, the high-pressure gas supplying unit is further installed with an air compressor coupled to the gas storage bucket, and the air compressor is electrically connected to the control circuit of the control unit; and the wind speed auxiliary unit is installed with at least one hatch cover disposed at a tubular side of the wind speed bucket, wherein the hatch cover is capable of opening and closing.

According to the above features, the high-pressure gas supplying unit is further installed with an air compressor coupled to the gas storage bucket, and the air compressor is electrically connected to the control circuit of the control unit; the wind speed auxiliary unit is installed with a lubricant bucket for storing lubricant and at least one lubricant pipe coupled to the lubricant bucket and a pivot setting location on a rotating axis of the motor, and the wind speed auxiliary unit is installed with at least one hatch cover disposed at a tubular side of the wind speed bucket, wherein the hatch cover is capable of opening and closing.

The booster burner disclosed by the present disclosure mainly utilizes the high-pressure gas supplying unit to accelerate fuel which enters the nozzle, to increase the atomization effect of the fuel which passes the nozzle, and simultaneously to increase the gas flow fluid which enters the burning chamber, therefore achieving the objective of increasing the fuel burning efficiency; and under the reaction of the wind speed auxiliary unit, the flowing speed and the flowing flux of the accelerating gas fluid are increased, so as to prevent the related units from affecting by the high temperature; even, by designing the jet pipe, relatively positive and reliable means are provided to increase the burning efficiency and thermal energy of the fuel, and not only the pollutants generated by burning the diesel and the heavy oil are reduced, but also the alcohol can be the used as the fuel, such the booster burner can be used in the room environments of the restaurant, the organization and the school.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
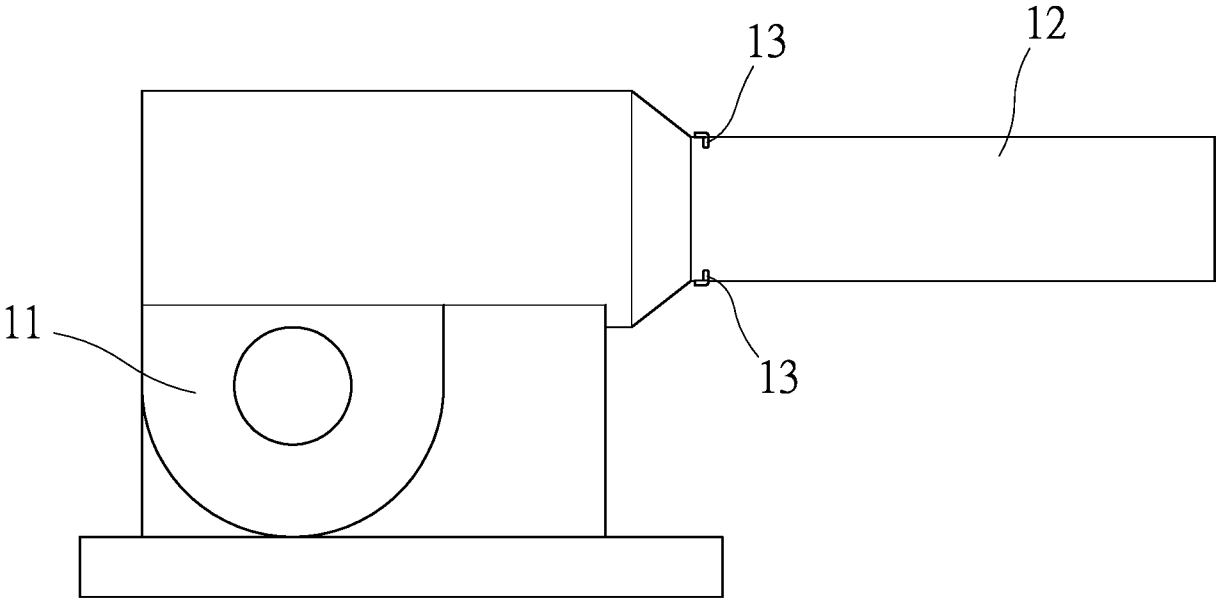
FIG. 1 Prior Art
FIG. 1 is architecture diagram of a conventional burner.
Figure 2:
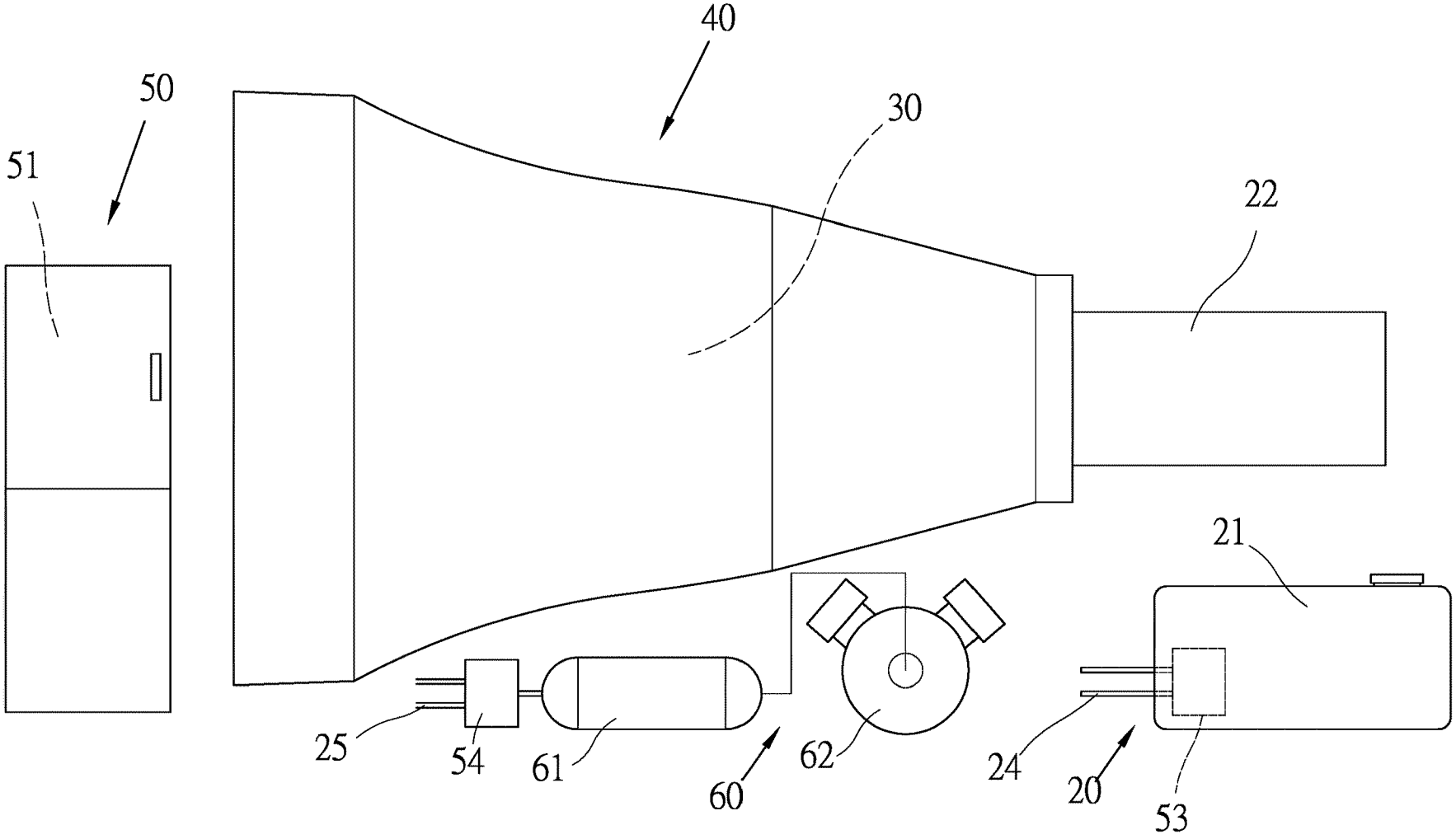
FIG. 2 is a basic architecture diagram of a booster burner according to a first embodiment of the present disclosure.
Figure 3:
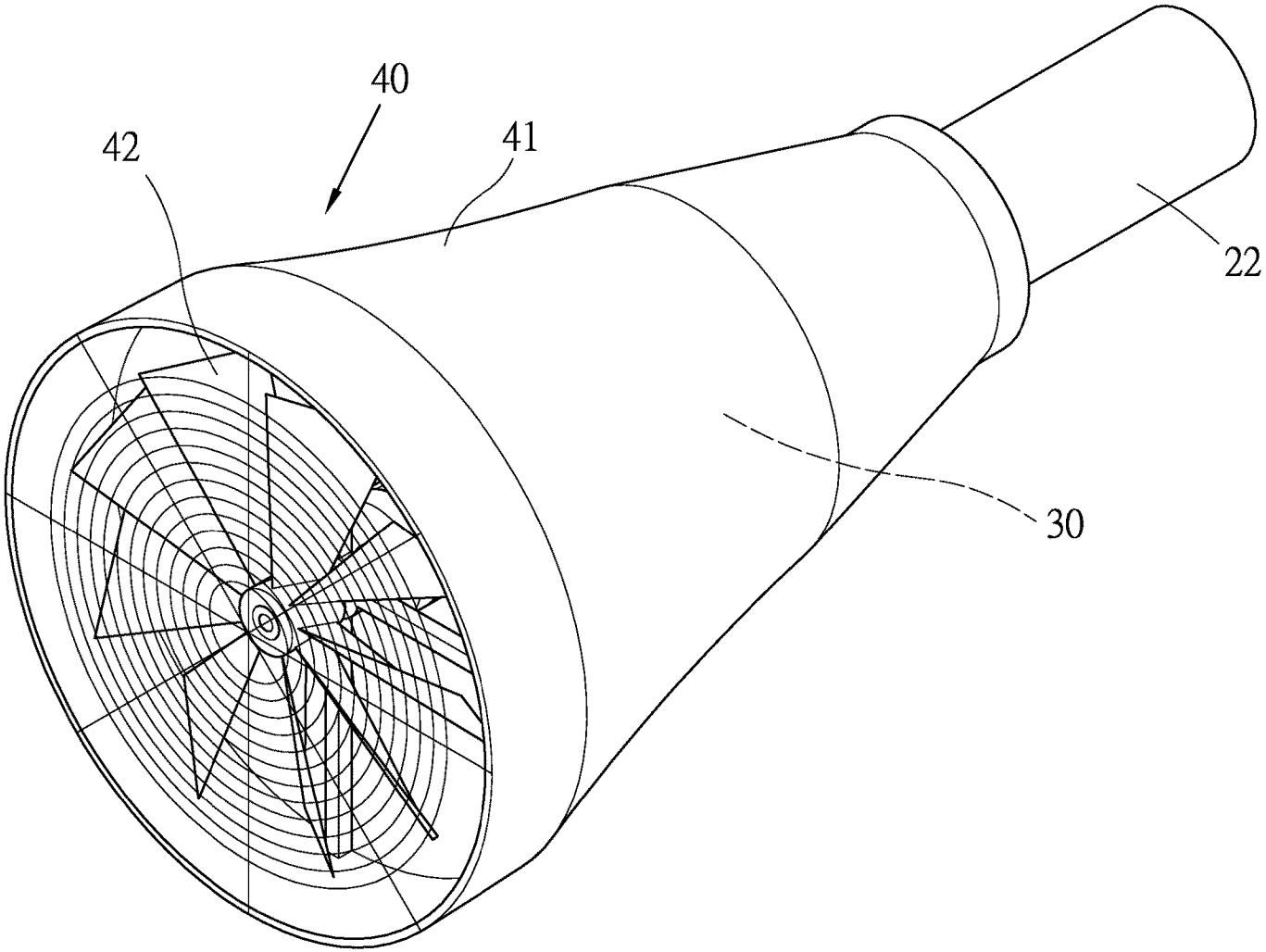
FIG. 3 is a three-dimensional outline diagram of a burning chamber and a wind speed auxiliary unit according to a first embodiment of the present disclosure.
Figure 4:
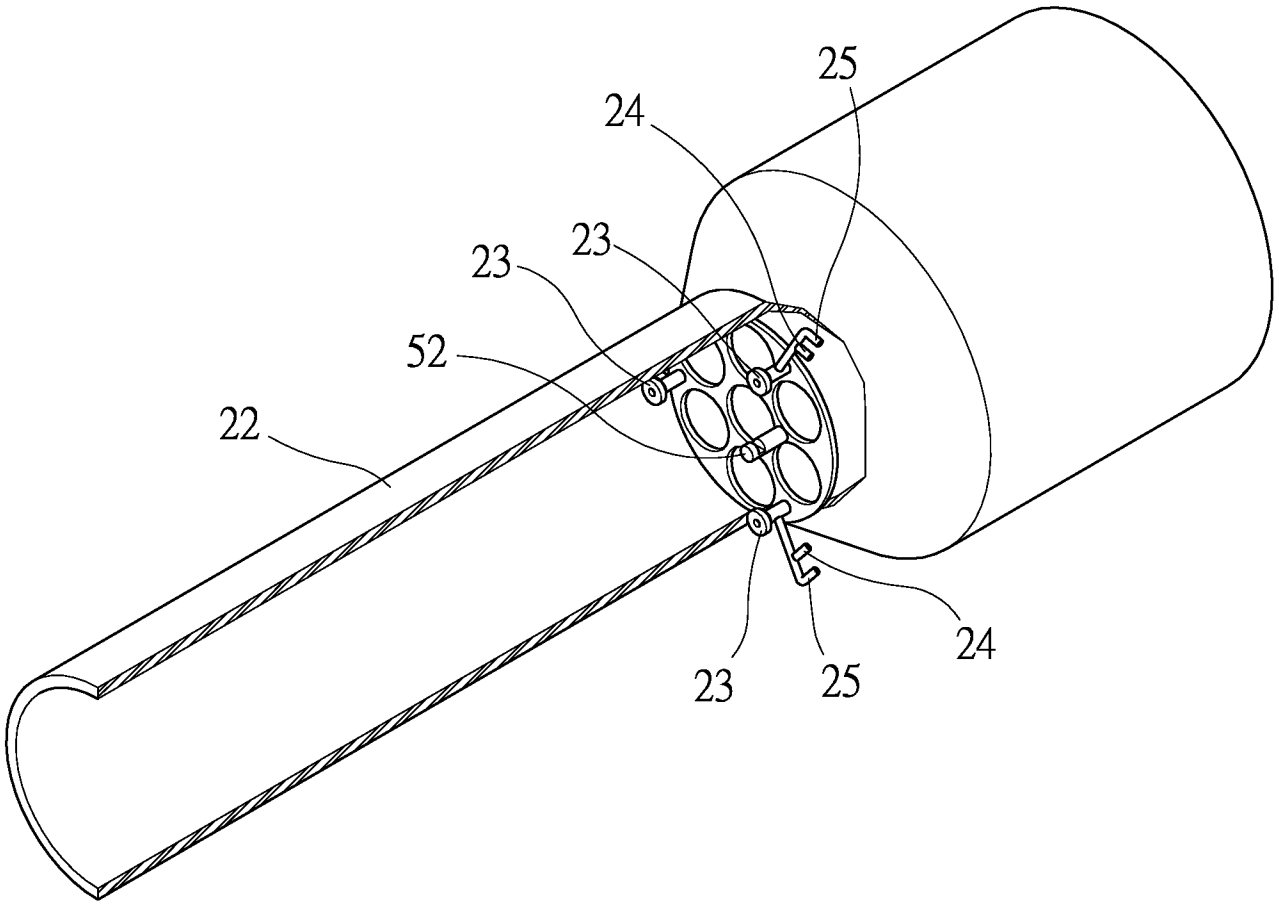
FIG. 4 is a sectional architecture diagram of a burning chamber of the present disclosure.
Figure 5:
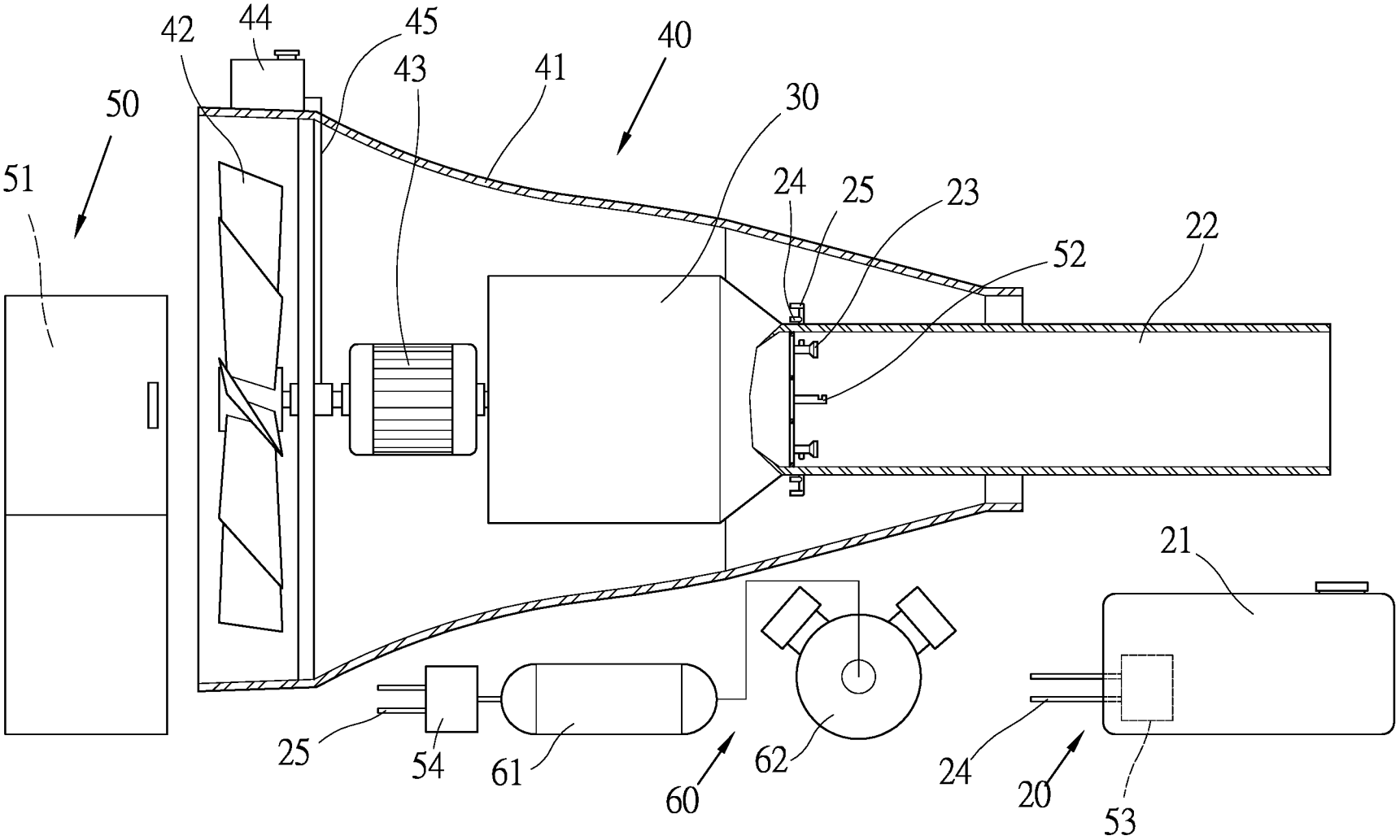
FIG. 5 is a sectional architecture diagram of a booster burner according to a first embodiment of the present disclosure.

To understand the technical features, content and advantages of the present disclosure and its efficacy, the present disclosure will be described in detail with reference to the accompanying drawings. The drawings are for illustrative and auxiliary purposes only and may not necessarily be the true scale and precise configuration of the present disclosure. Therefore, the scope of the present disclosure should not be limited to the scale and configuration of the attached drawings.

The present disclosure mainly provides a booster burner capable of increasing the fuel burning efficiency, and as shown in FIG. 2 through FIG. 5, the booster burner of the present disclosure basically at least comprises a burning unit 20, an air blower 30 and a high-pressure gas providing unit 60. The details of the above components are illustrated as follows.

The burning unit 20 is installed with a fuel bucket 21 for storing fuel and a burning chamber 22 having a tubular shape, interior of the burning chamber 22 is installed with at least one nozzle 23, and at least one fuel tube 24 coupled to the fuel bucket 21 is disposed at each the nozzle 23.

The air blower 30 is coupled to the burning chamber 22, such that the gas fluid can be boosted by the air blower 30, and then provided for the burning chamber 22. In one embodiment, the air blower 30 is disposed at a rear end of the burning chamber 22, and a wind blowing direction of the air blower 30 is parallel to an axis of the burning chamber 22; or alternatively, in another one embodiment, the air blower 30 is coupled to the burning chamber 22 via a pipeline (not shown in the drawings), and the pipeline communicates with the air blower 30 and the burning chamber 22, such that the gas fluid can be can be boosted by the air blower 30, and then provided for the burning chamber 22. When the booster burner is implemented in practice, the air blower 30 is preferably disposed on the axis of the burning chamber 22.

The high-pressure gas supplying unit 60 is installed with a gas storage bucket 61 for storing high-pressure gas, and each the nozzle 23 is installed with a high-pressure pipe 25 coupled to the gas storage bucket 61. When the booster burner is implemented in practice, the high-pressure gas supplying unit 60 is further installed with an air compressor 62 coupled to the gas storage bucket 61, and under the operation of the air compressor 62, the high-pressure gas can be continuously provided.

The wind speed auxiliary unit 40 is installed with a wind speed bucket 41 at least covering exterior of the air blower 30, a front end and a rear end of the wind speed bucket 41 are open, a gap for providing passage of a gas fluid is formed between the wind speed bucket 41 and the air blower 30, and the rear end of the wind speed bucket 41 is installed with a blade 42 and a motor 43 for driving the blade 42 to spin.

Figure 6:
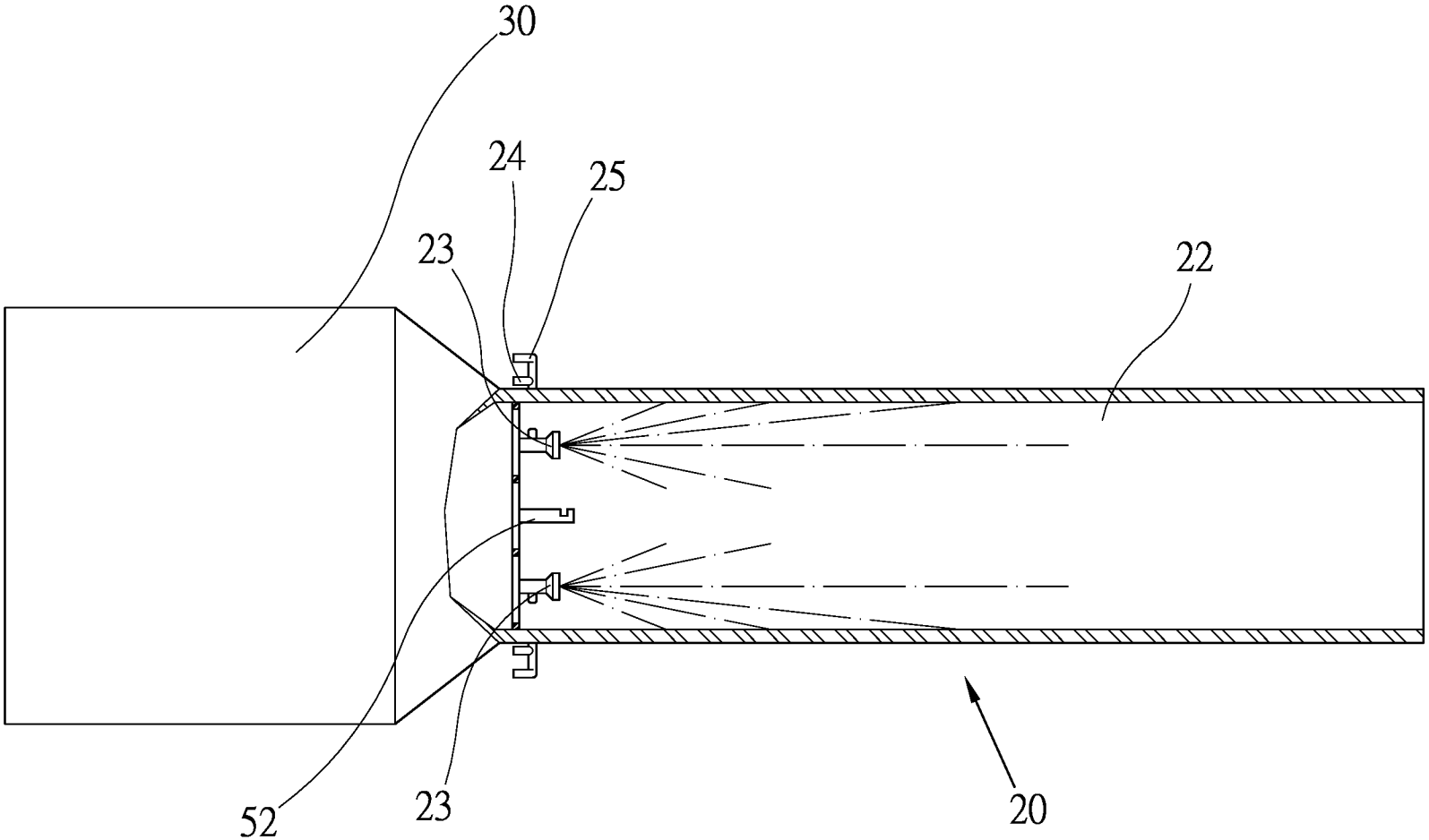
FIG. 6 is an operation diagram of a booster burner according to a first embodiment of the present disclosure.

Principally, when the booster burner of the present disclosure is operating, under the reaction of the air blower 30, the accelerating gas is generated in the interior of the burning chamber 22. After the fuel injected to the interior of the burning chamber 22 is fired, as shown in FIG. 6, accompanying with the accelerating gas fluid in the interior of the burning chamber 22, the fire is spurted and burned at the front end of the burning chamber 22. Especially, further by using the high-pressure gas provided by the high-pressure gas supplying unit 60, the acceleration effect is applied to the fuel which enters the nozzle 23, the atomization effect of the fuel which passes the nozzle 23 is increased, and the gas fluid which enters the burning chamber is increased simultaneously, therefore achieving the objective of increasing the fuel burning efficiency.

Furthermore, when the booster burner is implemented, the booster burner further comprises a control unit 50. The control unit 50 is installed with a control circuit 51, a lighter 52 correspondingly disposed in the interior of the burning chamber 22, a fuel pump 53 coupled to the fuel tube 24 of each the nozzle 23 and a throttle 54 coupled to the high-pressure pipe 25 of each the nozzle 23, and the control circuit 51 is at least electrically connected to the lighter 52, the fuel pump 53, the throttle 54 and the air blower 30.

Accordingly, when the control circuit 51 of the control unit 50 loads or sets the related work items and parameters, whether the lighter 52, the fuel pump 53, the throttle 54 and the air blower 30 operates can be controlled by the control unit 51 according to the selected or set work items or parameters, so as to achieve the objective of automatically operating.

When the booster burner of the present disclosure is implemented, the booster burner further comprises a wind speed auxiliary unit 40. The wind speed auxiliary unit 40 is installed with a wind speed bucket 41 at least covering exterior of the air blower 30, a front end and a rear end of the wind speed bucket 41 are open, a gap for providing passage of a gas fluid is formed between the wind speed bucket 41 and the air blower 30, and the rear end of the wind speed bucket 41 is installed with a blade 42 and a motor 43 for driving the blade 42 to spin.

Figure 7:
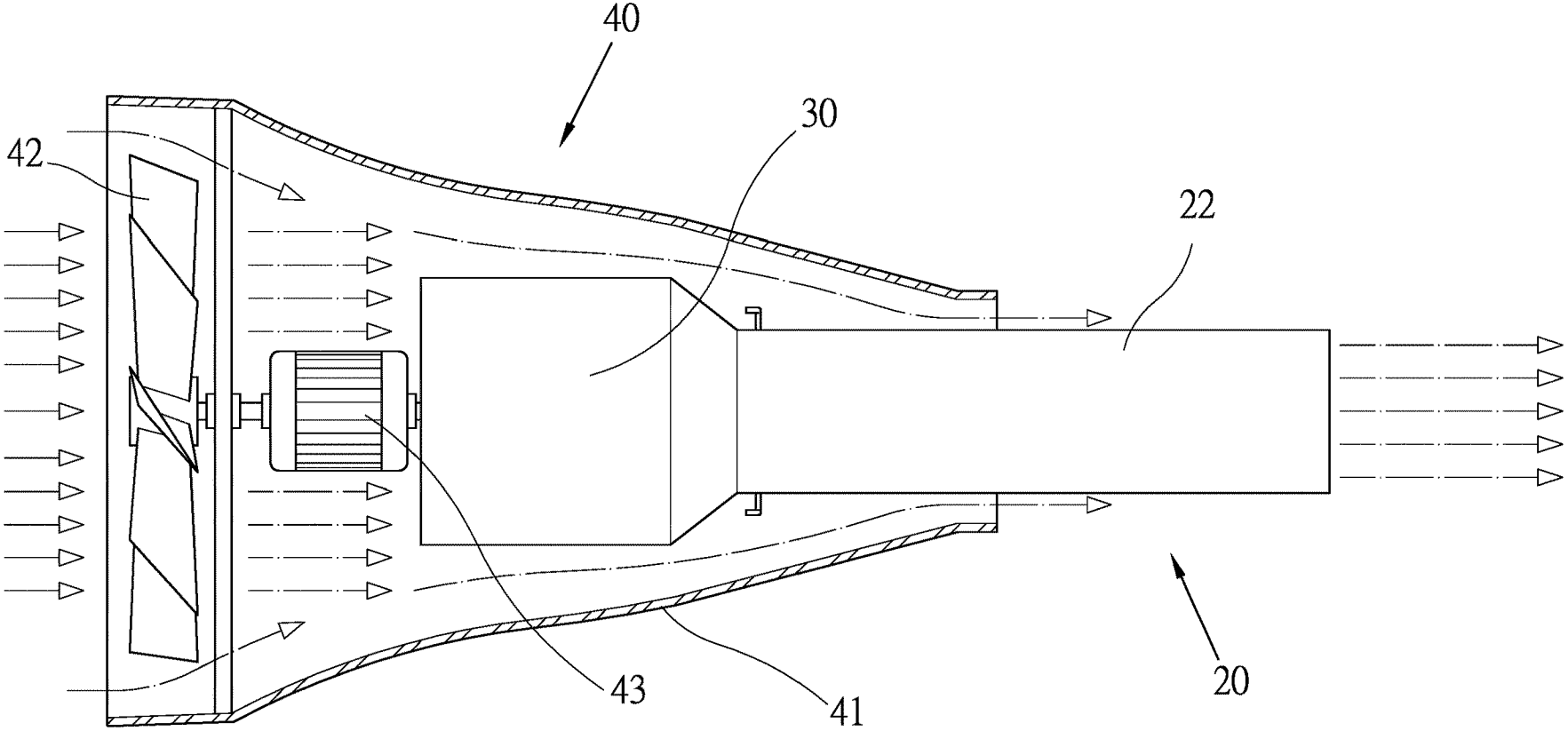
FIG. 7 is an operation diagram of a wind speed auxiliary unit of the present disclosure.

Accordingly, under the reaction and operation of the blade 42 of the wind speed auxiliary unit 40 (as shown in FIG. 7), the incoming gas fluid of the air blower 30 is increased, and not only the flowing speed and flowing flux of the accelerating gas fluid are increased, but also the partial gas fluid is accelerated to pass the gap formed between the wind speed bucket 41 and the air blower 30, therefore increasing the waste heat emission rates of the air blower 30 and the motor 43, and providing relatively positive and reliable means to prevent the related units from affecting by the high temperature.

It is noted that, under the reaction of the wind speed auxiliary unit 40, the booster burner of the present disclosure can increase the flowing speed and the flowing flux of the accelerating gas fluid, so as to reduce the dimension of the air blower 30, even by the design that the air blower 30 is disposed on the axis of the burning chamber 22, the outline shapes of the burning chamber 22, the air blower 30 and the wind speed auxiliary unit 40 can be integrated, so as to help the development of miniature and compacting of the burner.

Certainly, when the booster burner of the present disclosure is implemented, the booster further comprises the wind speed auxiliary unit 40 and the control unit 50. The wind speed auxiliary unit 40 is installed with a wind speed bucket 41 at least covering exterior of the air blower 30, a front end and a rear end of the wind speed bucket 41 are open, a gap for providing passage of a gas fluid is formed between the wind speed bucket 41 and the air blower 30, and the rear end of the wind speed bucket 41 is installed with a blade 42 and a motor 43 for driving the blade 42 to spin.

Regarding the control unit 50, the control unit 50 is installed with a control circuit 51, a lighter 52 correspondingly disposed in the interior of the burning chamber 22, a fuel pump 53 coupled to the fuel tube 24 of each the nozzle 23 and a throttle 54 coupled to the high-pressure pipe 25 of each the nozzle 23, the control circuit 51 is at least electrically connected to the lighter 52, the fuel pump 53, the throttle 54, the air blower 30 and the motor 43 of the wind speed auxiliary unit 40.

Figure 8:
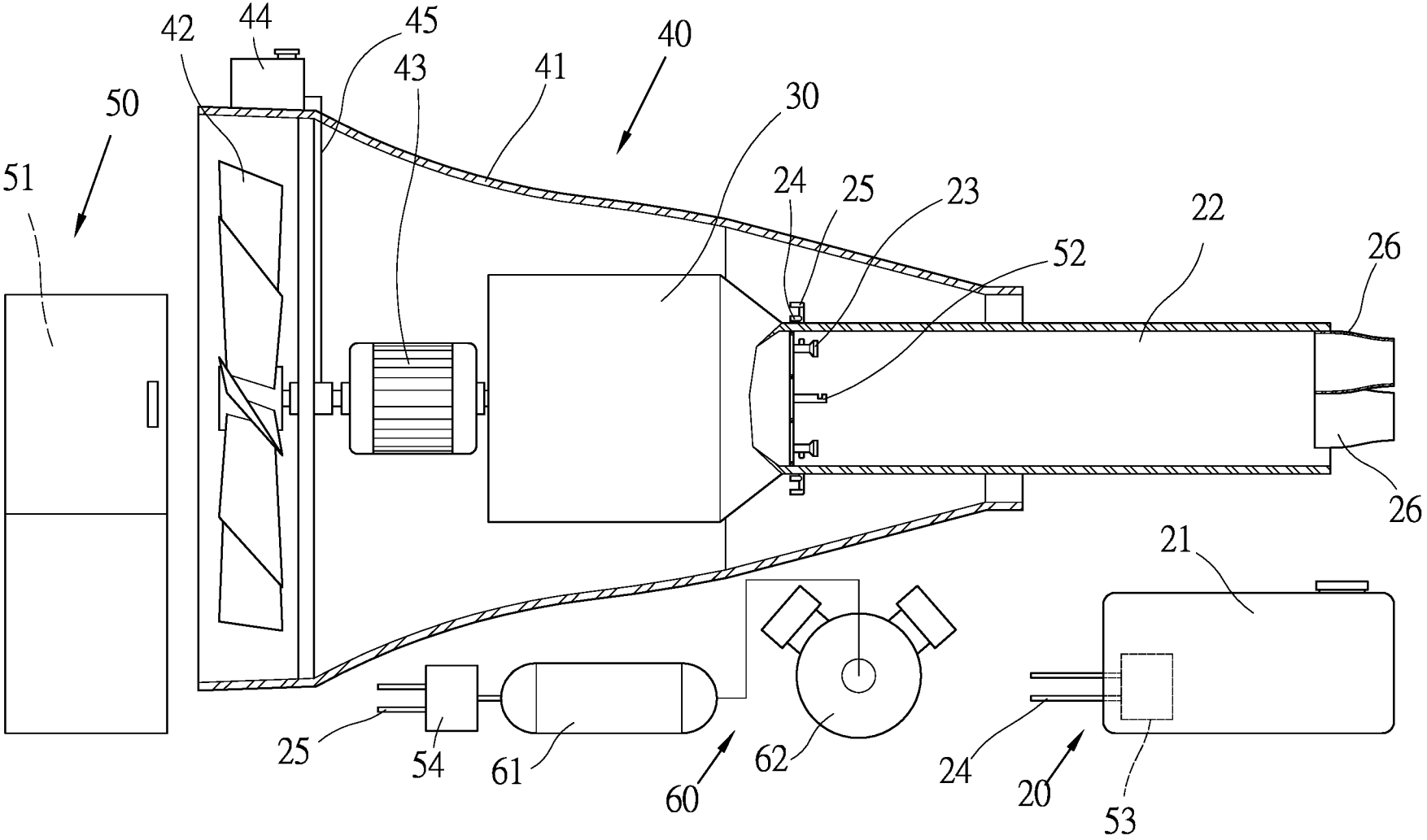
FIG. 8 is a sectional architecture diagram of a booster burner according to a second embodiment of the present disclosure.

Simultaneously referring to FIG. 8, when the booster burner of the present disclosure is implemented, the burning unit 20 is installed with at least one jet pipe 26 disposed at a front end of the burning chamber 22, and a pipe diameter of each the jet pipe 26 is less than an inner diameter of the burning chamber 22. Under the reaction of the jet pipes 26, the burning time of the fuel in the burning chamber 22 is increased, and the fire spurting distance of the fuel which has been burned is increased, therefore achieving the objective of increasing the thermal energy of the fuel burning.

When the booster burner of the present disclosure is implemented, the booster burner further comprises a control unit 50. The control unit 50 is installed with a control circuit 51, a lighter 52 correspondingly disposed in the interior of the burning chamber 22, a fuel pump 53 coupled to the fuel tube 24 of each the nozzle 23 and a throttle 54 coupled to the high-pressure pipe 25 of each the nozzle 23. The control circuit 51 is at least electrically connected to the lighter 52, the fuel pump 53, the throttle 54 and the air blower 30. The burning unit 20 is installed with at least one jet pipe 26 disposed at a front end of the burning chamber 22, and preferably, a pipe diameter of each the jet pipe 26 is less than an inner diameter of the burning chamber 22.

Certainly, when the booster burner of the present disclosure is implemented, the booster burner further comprises the wind speed auxiliary unit 40 and the control unit 50. The wind speed auxiliary unit 40 is installed with a wind speed bucket 41 at least covering exterior of the air blower 30, a front end and a rear end of the wind speed bucket 41 are open, a gap for providing passage of a gas fluid is formed between the wind speed bucket 41 and the air blower 30, the rear end of the wind speed bucket 41 is installed with a blade 42 and a motor 43 for driving the blade 42 to spin. The control unit 50 is installed with a control circuit 51, a lighter 52 correspondingly disposed in the interior of the burning chamber 22, a fuel pump 53 coupled to the fuel tube 24 of each the nozzle 23 and a throttle 54 coupled to the high-pressure pipe 25 of each the nozzle 23, and the control circuit 51 is at least electrically connected to the lighter 52, the fuel pump 53, the throttle 54, the air blower 30 and the motor 43 of the wind speed auxiliary unit 40. The burning unit 20 is installed with at least one jet pipe 26 disposed at a front end of the burning chamber 22, and preferably, a pipe diameter of each the jet pipe 26 is less than an inner diameter of the burning chamber 22.

In all above possible implementations of the present disclosure, the wind speed auxiliary unit 40 can further be installed with a lubricant bucket 44 for storing lubricant and at least one lubricant pipe 45 coupled to the lubricant bucket 44 and a pivot setting location on a rotating axis of the motor 43. By using the lubricant bucket 44 and the lubricant pipe 45, lubricant is usually provided for the pivot setting location on a rotating axis of the motor 43 (i.e. the bearing location of the motor 43), so as to ensure the motor 43 can operate successfully, and to increase the entire operation efficiency of the booster burner.

Figure 9:
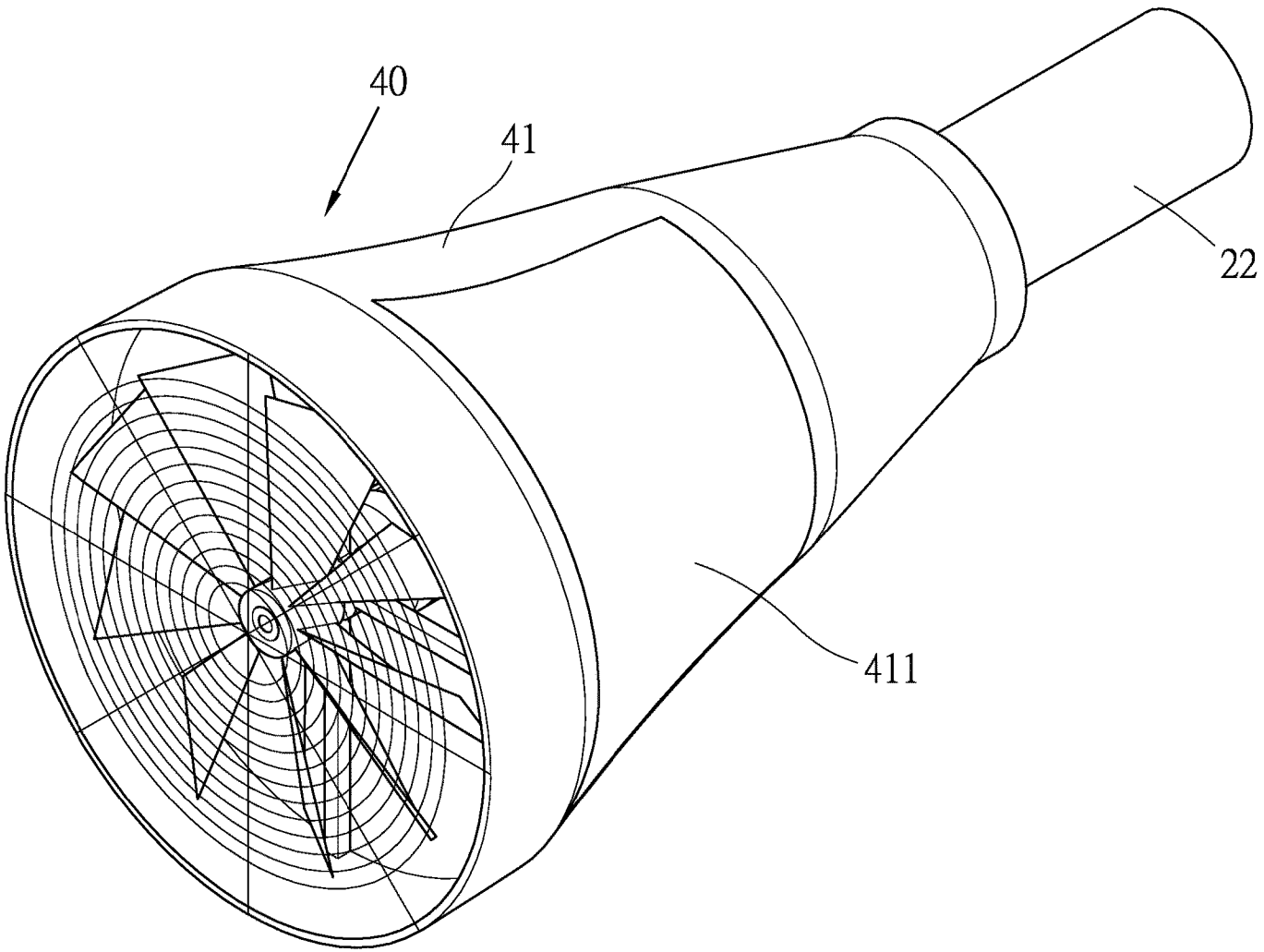
FIG. 9 is a three-dimensional outline diagram of a burning chamber and a wind speed auxiliary unit according to a third embodiment of the present disclosure.

Simultaneously referring to FIG. 9, in all above possible implementations of the present disclosure, the wind speed auxiliary unit 40 is installed with at least one hatch cover 411 disposed at a tubular side of the wind speed bucket 41, wherein the hatch cover 411 is capable of opening and closing. By the design of the hatch cover 411, it is convenient to check and install the related units.

Certainly, the wind speed auxiliary unit 40, as shown in FIG. 8 and FIG. 9, the wind speed auxiliary unit 41 is installed with a lubricant bucket 44 for storing lubricant and at least one lubricant pipe 45 coupled to the lubricant bucket 44 and a pivot setting location on a rotating axis of the motor 43, and the wind speed auxiliary unit 41 is preferably installed with at least one hatch cover 411 disposed at a tubular side of the wind speed bucket 41, wherein the hatch cover 411 is capable of opening and closing.

Moreover, the booster burner of the present disclosure can further comprise the control unit 50, and the high-pressure gas supplying unit 60 can be further installed with an air compressor 62 coupled to the gas storage bucket 61, and the air compressor 62 is electrically connected to the control circuit 51 of the control unit 50. The high-pressure gas is continuously provided under the operation the air compressor 62.

The booster burner of the present disclosure can further comprise the control unit 50, and the high-pressure gas supplying unit 60 is further installed with an air compressor 62 coupled to the gas storage bucket 61, and the air compressor 62 is electrically connected to the control circuit 51 of the control unit 50. In the embodiment that the air compressor 62 is electrically connected to the control circuit 51 of the control unit 50, the wind speed auxiliary unit 40 is installed with a lubricant bucket 44 for storing lubricant and at least one lubricant pipe 45 coupled to the lubricant bucket 44 and a pivot setting location on a rotating axis of the motor 43.

The booster burner of the present disclosure can further comprise the control unit 50, and the high-pressure gas supplying unit 60 is further installed with an air compressor 62 coupled to the gas storage bucket 61, and the air compressor 62 is electrically connected to the control circuit 51 of the control unit 50. In the embodiment that the air compressor 62 is electrically connected to the control circuit 51 of the control unit 50, the wind speed auxiliary unit 40 is installed with at least one hatch cover 411 disposed at a tubular side of the wind speed bucket 41, wherein the hatch cover 411 is capable of opening and closing.

Certainly, he booster burner of the present disclosure can further comprise the control unit 50, and the high-pressure gas supplying unit 60 is further installed with an air compressor 62 coupled to the gas storage bucket 61, and the air compressor 62 is electrically connected to the control circuit 51 of the control unit 50. In the embodiment that the air compressor 62 is electrically connected to the control circuit 51 of the control unit 50, the wind speed auxiliary unit 40 is installed with a lubricant bucket 44 for storing lubricant and at least one lubricant pipe 45 coupled to the lubricant bucket 44 and a pivot setting location on a rotating axis of the motor 43, and the wind speed auxiliary unit 40 is preferably installed with at least one hatch cover 411 disposed at a tubular side of the wind speed bucket 41, wherein the hatch cover 411 is capable of opening and closing.

Compared with the prior art, the booster burner of the present disclosure mainly uses the high-pressure gas to apply the atomization and acceleration effect on the fuel which enters the nozzle, such that fuel molecules are refined and more completely burned, and the objective of increasing the fuel burning efficiency is achieved. Further, under the reaction of the air blower, the gas fluid incoming the burning chamber is increased, therefore achieving the objective of increasing the fuel burning efficiency. Even, under the reaction of the wind speed auxiliary unit, the flowing speed and the flowing flux of the accelerating gas fluid are increased, so as to prevent the related units from affecting by the high temperature. Even, by designing the jet pipe, relatively positive and reliable means are provided to increase the burning efficiency and thermal energy of the fuel, and not only the pollutants generated by burning the diesel and the heavy oil are reduced, but also the alcohol can be the used as the fuel, such the booster burner can be used in the room environments of the restaurant, the organization and the school.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A booster burner, at least comprising: a burning unit, an air blower and a high-pressure gas providing unit; wherein:

the burning unit is installed with a fuel bucket for storing fuel and a burning chamber having a tubular shape, interior of the burning chamber is installed with at least one nozzle, at least one fuel tube coupled to the fuel bucket is disposed at each the nozzle; the air blower is coupled to the burning chamber; and the high-pressure gas supplying unit is installed with a gas storage bucket for storing high-pressure gas, each the nozzle is installed with a high-pressure pipe coupled to the gas storage bucket;

wherein the booster burner further comprises a wind speed auxiliary unit and a control unit; the wind speed auxiliary unit is installed with a wind speed bucket at least covering exterior of the air blower, a front end and a rear end of the wind speed bucket are open, a gap for providing passage of a gas fluid is formed between the wind speed bucket and the air blower, the rear end of the wind speed bucket is installed with a blade and a motor for driving the blade to spin; the control unit is installed with a control circuit, a lighter correspondingly disposed in the interior of the burning chamber, a fuel pump coupled to the fuel tube of each the nozzle and a throttle coupled to the high-pressure pipe of each the nozzle, the control circuit is at least electrically connected to the lighter, the fuel pump, the throttle, the air blower and the motor of the wind speed auxiliary unit.

2. A booster burner, at least comprising: a burning unit, an air blower and a high-pressure gas providing unit; wherein:

the burning unit is installed with a fuel bucket for storing fuel and a burning chamber having a tubular shape, interior of the burning chamber is installed with at least one nozzle, at least one fuel tube coupled to the fuel bucket is disposed at each the nozzle; the air blower is coupled to the burning chamber; and the high-pressure gas supplying unit is installed with a gas storage bucket for storing high-pressure gas, each the nozzle is installed with a high-pressure pipe coupled to the gas storage bucket; and the burning unit is further installed with at least one jet pipe disposed at a front end of the burning chamber, and a pipe diameter of each the jet pipe is less than an inner diameter of the burning chamber.

3. The booster burner according to claim 1, wherein the wind speed auxiliary unit is installed with a lubricant bucket for storing lubricant and at least one lubricant pipe coupled to the lubricant bucket and a pivot setting location on a rotating axis of the motor.

4. The booster burner according to claim 1, wherein the wind speed auxiliary unit is installed with at least one hatch cover disposed at a tubular side of the wind speed bucket, wherein the hatch cover is capable of opening and closing.

5. The booster burner according to claim 1, wherein the wind speed auxiliary unit is installed with a lubricant bucket for storing lubricant and at least one lubricant pipe coupled to the lubricant bucket and a pivot setting location on a rotating axis of the motor, and the wind speed auxiliary unit is installed with at least one hatch cover disposed at a tubular side of the wind speed bucket, wherein the hatch cover is capable of opening and closing.

6. The booster burner according to claim 1, wherein the high-pressure gas supplying unit is further installed with an air compressor coupled to the gas storage bucket, and the air compressor is electrically connected to the control circuit of the control unit.

7. The booster burner according to claim 1, wherein the high-pressure gas supplying unit is further installed with an air compressor coupled to the gas storage bucket, and the air compressor is electrically connected to the control circuit of the control unit; and the wind speed auxiliary unit is installed with a lubricant bucket for storing lubricant and at least one lubricant pipe coupled to the lubricant bucket and a pivot setting location on a rotating axis of the motor.

8. The booster burner according to claim 1, wherein the high-pressure gas supplying unit is further installed with an air compressor coupled to the gas storage bucket, and the air compressor is electrically connected to the control circuit of the control unit; and the wind speed auxiliary unit is installed with at least one hatch cover disposed at a tubular side of the wind speed bucket, wherein the hatch cover is capable of opening and closing.

9. The booster burner according to claim 1, wherein the high-pressure gas supplying unit is further installed with an air compressor coupled to the gas storage bucket, and the air compressor is electrically connected to the control circuit of the control unit; the wind speed auxiliary unit is installed with a lubricant bucket for storing lubricant and at least one lubricant pipe coupled to the lubricant bucket and a pivot setting location on a rotating axis of the motor, and the wind speed auxiliary unit is installed with at least one hatch cover disposed at a tubular side of the wind speed bucket, wherein the hatch cover is capable of opening and closing.

10. The booster burner according to claim 1, wherein the air blower is disposed at a rear end of the burning chamber, and a wind blowing direction of the air blower is parallel to an axis of the burning chamber.

11. A booster burner, at least comprising: a burning unit, an air blower and a high-pressure gas providing unit; wherein:

the burning unit is installed with a fuel bucket for storing fuel and a burning chamber having a tubular shape, interior of the burning chamber is installed with at least one nozzle, at least one fuel tube coupled to the fuel bucket is disposed at each the nozzle; the air blower is coupled to the burning chamber via a pipeline; and the high-pressure gas supplying unit is installed with a gas storage bucket for storing high-pressure gas, each the nozzle is installed with a high-pressure pipe coupled to the gas storage bucket.

* * * * *